United States Patent [19]

Ramsby

[11] 4,134,182

[45] Jan. 16, 1979

[54] HOLDER FOR SKIS AND POLES

[76] Inventor: Henry S. Ramsby, 3600 C, N. Townhall, Traverse City, Mich. 49684

[21] Appl. No.: 849,970

[22] Filed: Nov. 9, 1977

[51] Int. Cl.[2] ..... A44B 21/00

[52] U.S. Cl. ..... 24/81 SK; 24/81 CC; 224/45 S; 280/11.37 K

[58] Field of Search ..... B60R/7/00; 24/81 SK, 24/81 CC, 73 SG; 224/45 S, 52; 280/11.37 K, 11.37 A; 211/60 SK

[56] References Cited

U.S. PATENT DOCUMENTS

| | | | |
|---|---|---|---|
| 3,626,553 | 12/1971 | Darney | 24/81 SK |
| 3,737,956 | 6/1973 | Gragert | 24/81 SK |

*Primary Examiner*—Bernard A. Gelak
*Attorney, Agent, or Firm*—Blanchard, Flynn, Thiel, Boutell & Tanis

[57] ABSTRACT

A holder for a pair of skis and a pair of ski poles consists of a one-piece body of shape retaining but bendable synthetic resin material. The one-piece body incorporates a pair of opposed, mirror-imaged coat hanger shaped portions and a bendable bar spacing and integrally connecting the opposed central parts of the coat hanger shaped portions. The latter each comprise a crossarm centered on and extending transversely of the end of the bar and curved to face concavely toward the opposed concave face of the other crossarm. The end portions of the crossarms, together with opposed flanges at the free ends thereof, are elastically bendable away from each other and from the bar to permit insertion of the cross section of a ski into snugly supported relation therebetween. The clothes hanger shaped portions further include generally question mark shaped hooks extending integrally and oppositely from the crossarm centers. The hooks are of wider stiffer cross section than the crossarms but have free end portions bendable elastically outward to admit a ski pole into snug gripped relation with their curvature. When a pair of holders engages a pair of ski poles to a pair of skis, and one of the poles is used in the manner of a handle to support the skis, poles and holders, the supporting pole presses on the inner surface of the hook in a direction almost diametrally away from the opening of the hook.

8 Claims, 8 Drawing Figures

HOLDER FOR SKIS AND POLES

FIELD OF THE INVENTION

This invention relates to a holder for a pair of snow skis and a corresponding pair of ski poles, and more particularly relates to such a holder usable for securing together such skis and poles for handling, transport and storage.

BACKGROUND OF THE INVENTION

Skiers have long known the difficulty in simultaneously handling a pair of skis and a pair of ski poles. Unless they are somehow tied together, the substantial length and mutually interfering configuration of these four members, and their ability to catch the wind and readily slide with respect to one another, normally requires considerable concentration and dexterity, as well as the use of both hands, by the user.

In response to this problem numerous and varied structures have been proposed over the years. However, none, of which I am aware, have been entirely satisfactory. Simple straps encircling the quartet of skis and poles tend to slide longitudinally thereon or permit the skis and poles to slide with respect to each other, and, in addition, must be equipped with buckles or other fastening devices which may be difficult to manipulate with gloved, mittened or cold numbed hands, particularly if the latching mechanism is clogged with ice or snow.

More sophisticated proposals have avoided the attempted securement of the skis and poles merely by encirclement with a strap, cord or the like, and instead have provided structures with different parts for gripping each ski and pole individually. Examples include U.S. Pat. Nos. 3,626,553 and 3,737,956 (Darney et al. and Gragert, respectively). Gragert, however, proposes a relatively complex multipiece structure, wherein the several pieces are of different physical characteristics, necessitating the use of different materials therefor, as well as labor and assembling together of the parts prior to use. In addition, the stretchable holding cords for the ski poles are such as to require the members holding the edges of the skis to be rigid because otherwise they would tend to bend, back away from the skis, loosening the grip on the skis.

Darney, on the other hand, has a spring clip arrangement in which the bottoms of the skis are held in frictional contact with the central member of the clip across the entire width of the ski bottom for purposes of maintaining the connection of the clip to the skis, and wherein installation of the clip involves sliding of said central member longitudinally for a distance along the bottom of such skis, either of which may disturb the condition of the usual wax coating on the ski bottoms. Further, retention of the skis within the clip depends on engagement of the side edge of each ski by only a single abutment surface which is narrow compared to the thickness of the ski, leading to the risk of unintentional loss of the ski from the clip in casual or rough handling even with spring retention forces sufficiently high as to aggrevate the aforementioned wax disruption problem. Further, the clip can only hold the ski poles in very close spaced side-by-side relation such that the annular basket, even down to the central hub portion thereof, of one ski pole will interfere with the other ski pole, necessitating inconvenient opposite direction of and axial upsetting of the ski poles when installed on the clips.

Further, unless the baskets are quite small, they may further tend to interfere with the skis installed on the clips and in such a way as to tend to push the ski poles in a direction out of, rather than into, their sockets on the clips. Installation of the poles on the clips is hampered by the convergence of the leaflike pole socket defining portions of the clip, along with the absence of any significant funneling surfaces, the problem being compounded when the user's hands are mittened or gloved.

Accordingly, none of the prior art ski and pole holding devices, of which I am aware, have won complete acceptance or been intirely satisfactory in use.

Accordingly, the objects of the present invention include provision of:

A holder for both a pair of skis and a pair of ski poles constructable as a unitary article moldable at low cost from relatively inexpensive resin material, which though bendable need not be stretchable.

A holder, as aforesaid, in which primary gripping engagement of the skis is on the side and top surfaces thereof with but minimum contact with the bottom running surfaces of the skis so as to minimize frictional contact with waxed surfaces thereof, and wherein longitudinal sliding movement of the skis with respect to the clips is avoided even during installation and removal of the holders with respect to the skis.

A holder, as aforesaid, in which the bendable ski holding members are relatively short as compared to the width of the ski, and wherein the ski side gripping members have end flange portions partially overlying the tops of the skis to assist gripping thereof, such that the holder material need only have relatively modest elastic return capability to securely grip the ski following deformation of such members to admit the ski into its socket.

A holder, as aforesaid, which provides a funnellike leadin zone width and length substantially exceeding the ski pole diameter, to assist in installation of the ski poles in their sockets on the holder and permit easy accomplishment of such installation even when the user's hands are gloved or mittened.

A holder, as aforesaid, which widely separates the ski poles though holding same in parallel relation with each other and with the skis, to avoid interference of the pole basket hubs of each pole with the other pole.

A holder, as aforesaid, which permits use of the central portion of one pole as a carrying handle for the skis and remaining pole in such way that the weight of the skis and remaining pole tend to seat the one pole more firmly in its socket on the holder rather than to remove same therefrom, and further wherein when the ski-holder-pole assembly is being so carried, the skis and remaining pole tend to seat themselves more deeply within their retention sockets on the holder rather than tending to eject themselves from the holder, even under rough handling.

Other objects and purposes of the invention will be apparent to persons acquainted with articles of this general type upon reading the following specification and inspecting the accompanying drawings.

SUMMARY OF THE INVENTION

The objects and purposes of the invention are met by providing a holder for a pair of skis and a pair of ski poles consisting of a one-piece body of shape retaining but bendable synthetic resin material. The one-piece body incorporates a pair of opposed, mirror-imaged cost hanger-shaped portions and a bendable bar spacing and integrally connecting the opposed central parts of the coat hanger-shaped portions. The latter each comprise a crossarm centered on and extending transversely of the end of the bar and curved to face concavely toward the opposed concave face of the other crossarm. The end portions of the crossarms, together with opposed flanges at the free ends thereof, are elastically bendable away from each other and from the bar to permit insertion of the cross section of a ski into snugly supported relation therebetween. The clothes hanger-shaped portions further include generally question mark shaped hooks extending integrally and oppositely from the crossarm centers. The hooks are of wider, stiffer cross section than the crossarms but have free end portions bendable elastically outward to admit a ski pole into snug gripped relation within their curvature. When a pair of holders engages a pair of ski poles to a pair of skis, and one of the poles is used in the manner of a handle to support the skis, poles and holders, the supporting pole presses on the inner surface of the hook in a direction almost diametrally away from the opening from the hook.

DETAILED DESCRIPTION

The holder 10 (FIGS. 2–4) embodying the invention is a one-piece body of shaped-retaining but bendable synthetic resin material. The unitary holder is preferably constructed by an injection molding operation. The holder is configured to permit it to be molded from relatively inexpensive moldable material (for example consierably less costly than rubber), and in one embodiment a synthetic resin material marketed under the tradename Creton by Shell Chemical Company, Cleveland, Ohio was successfully employed. As hereafter discussed, high quality high cost materials are not required since no portion of the holder need to stretchable, requirements for bendability are relatively modest, and full elastic return from a bent condition need not be complete or immediate for adequate retention of skis and poles in the holder.

Figure 3:
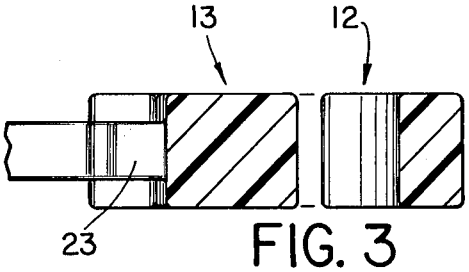
FIG. 3 is a sectional view substantially taken along the line III—III of FIG. 2.
Figure 4:
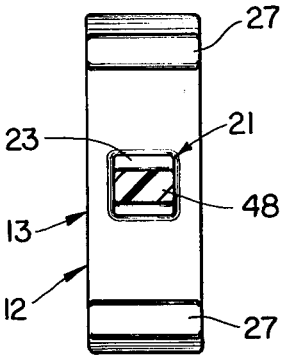
FIG. 4 is a sectional view taken substantially along the line IV—IV of FIG. 2.

The one-piece holder 10 incorporates a pair of mirror-imaged but otherwise preferably identical, clothes hanger-shaped portions 12. The portions 12 each have a central, joinder zone 13 and a substantially question mark shaped hook 15 and a curved crossarm 17, the central or joinder portion 13 constituting the part of the clothes hanger-shaped portion at which the base 18 of the hook 15 integrally connects with the center 19 of the crossarm 17. As seen in FIG. 3 and 4, the hanger-shaped portions are of uniform thickness.

Figure 2:
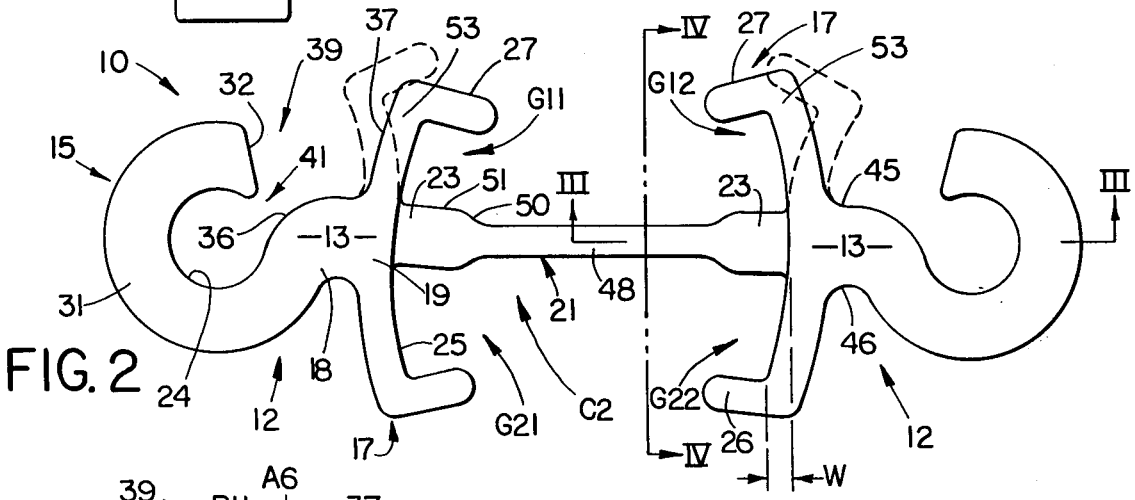
FIG. 2 is an enlarged top view of a preferred embodiment of the invention, taken along the longitudinal direction of the skis or poles to be held thereby.

The unitary holder 10 further includes a bar 21 whose ends integrally connect to the hanger-shaped portions at the joinder zones 13 thereof. The bar 21 holds the hanger-shaped portions 12 spaced away from each other with their respective crossarms 17 opposed. As seen in FIGS. 2–4, the ends 23 of the bar 21 are at the center 19 of the respective crossarms 17.

The crossarms 17, in their rest state shown in FIG. 2, are curved in a substantially semicircular manner, the crossarms 17 having concavely curved inside faces 25 facing toward each other. The free ends of the opposed semicircular crossarms 17 carry integral flanges 27 extending substantially at right angles from the crossarm free ends and, due to the normal rest curvature of the crossarms, being angled convergedly toward the opposite hanger-shaped portion. The free ends of the flanges 27 are convexly rounded in profile to assist to insertion of skis into the holder.

Curved portion 31 of hook 15 extends semicircularly from the base 18 thereof and terminates in a free end 32 facing in a direction parallel to the extent of the base 18 and toward one end segment of the crossarm 17. The curved portion 31 surrounds the majority, though not the entirety, of circular hole 34, the diameter of which is preferably slightly less than that of a ski pole to be received therein to permit the snug gripping of the ski pole and frictional holding thereof against axial movement with respect to the hook 15. The free end surface at 32 does not extend radially from the axis of hole 34 but instead is sloped back through an angle so as to extend virtually on a tangent of the opening 34. The opposite surface 36, where the base 18 joins the semicircular curved portion 31 of the hook 15, is convexly curved toward the free end 32. As hereafter discussed, the free end 32 on the one hand and the convex surface 36 and outer face 37 of the opposed crossarm segment, on the other hand, form a funnel 39 leading to and guiding entry of a ski pole laterally into the hole 34. The gap 41 between the edge of free end 32 and the convex face 36 is sized substantially less than the diameter of the hole 34 or ski pole, for example, about one-half the diameter of hole 34, to assure retention of a ski pole in the hole 34 against unintended removal therefrom.

Whereas the thickness (as seen in FIGS. 3 and 4) of the hanger-shaped portions is constant throughout, the width (as seen in FIG. 2) of the hook 15 is substantially greater than the width of the crossarm 17. On the other hand, the width of the hook 15 throughout its length remains substantially constant and the width of the crossarm 17 with its end flanges 27, remains substantially constant. Generously sized fillets 45 and 46 join the base 18 of hook 15 to the central portion of the crossarm.

The bar 21 integrally joining the hanger-shaped portions 12 at central zones 13 is of substantially constant thickness, as seen in FIGS. 3 and 4, which is about half the thickness of the hanger-shaped portions 12. The major central length 48 of the bar 21 is of reduced substantially constant width, as seen in FIG. 2. In the preferred embodiment shown, this width is somewhat less (for example about two-thirds of) the width of the free portions of the cross arms 17. However, the ends 23 of the bar 48 are substantially spade-shaped and of increased width, here widening gradually at 50 to their full width at 51 which approximates, in the particular embodiment shown, the cross-sectional width of the hook 15. The maximum width part 51 of the bar end 23 is filleted at its integral connection with the central zone 13 of the ocrresponding hanger-shaped portion 12.

As will be seen from the following description of operation, the loading and unloading of skis and poles is accommodated by the ability of portions of the holder 10 to bend out of the way and, upon release, return substantially to an original rest position to hold the ski or pole in place in the holder. Loading and unloading of skis and poles with respect to the holder does not require portions of the holder to stretch longitudinally, permitting injection molding of the holder from relatively inexpensive material of only relatively moderate elastic capability, particularly minimal in tension.

Skis and poles can be loaded and unloaded from the holder in any order desired. However, for convenience, operation of the holder will be described below with attention first given to the loading of the skis and then of the poles. For convenience in the following discussion, the holder 10 may be said to define first and second ski receiving channels generally indicated at C1 and C2 (FIG. 2), which channels are separated by the bar 21 and are each defined by bar 21, opposed ends 53 of the crossarms of the opposed hanger-shaped portions, and the opposed flanges 27 carried by the latter. Further, each such channel C1, C2, respectively, has edge grooves generally indicated at G11 and G12, G21 and G22, each such edge groove being bounded by the corresponding flange 27, crossarm end 17 and bar end 23.

Figure 5:
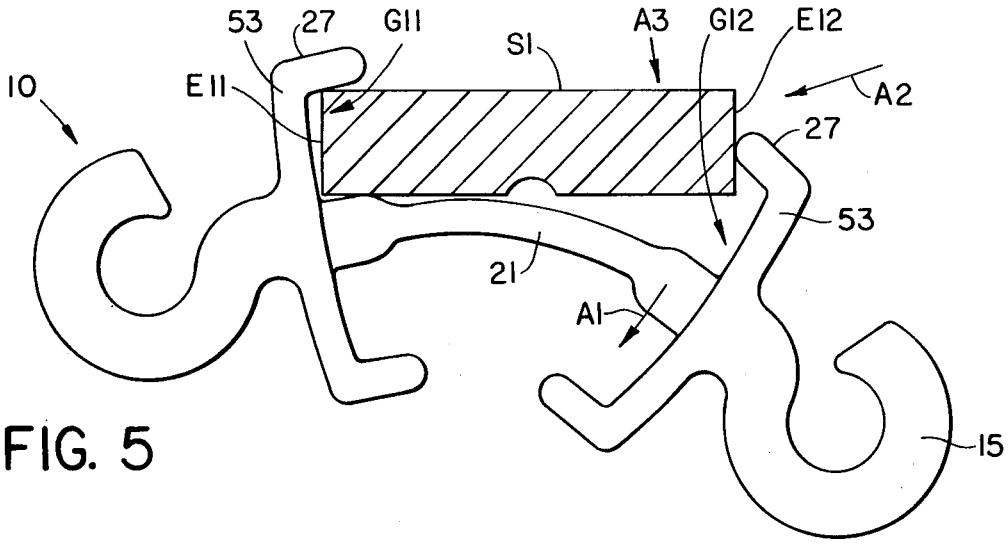
FIGS. 5 and 6 are views similar to FIG. 2 but with one ski, respectively, in the process of being installed in, and fully installed in the holder.
Figure 6:
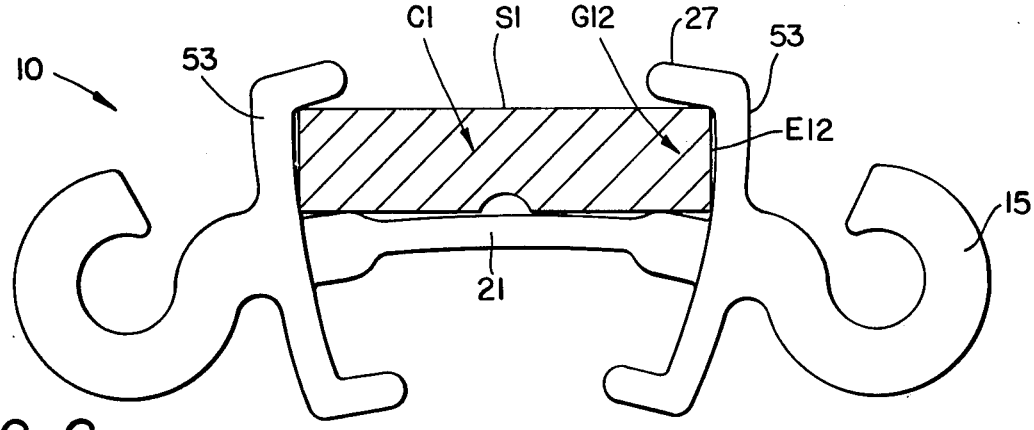

With the holder 10 in its rest condition of FIG. 2, the bar 21 may be bent, as in the direction indicated by arrow A1 of FIG. 5, to widen the spacing between the upper flanges 27 and such that the groove G11 faces outward beyond the opposing flange 27 rather than toward the normally opposing edge groove G12. This permits edge E11 of ski S1 moving generally in the direction of arrow A2 in FIG. 5 to pass the rightward flange 27 and enter the groove G11. Thereafter, maintaining the bar 21 bent as shown, the rightward edge E12 of ski S1 may be moved downward, substantially in the direction of arrow A3, past rightward flange 27 and into the rightward groove G12. These operations are readily accomplished with, for example, rightward hook 15 held by one hand of the user to control the bending of bar 21 and ski S1 appropriately held as by the other hand of the user. At this point, the ends 53 and flanges 27 of the crossarms need undergo little or no bending from the rest position. With the ski edge E12 moved past rightward flange 27 into groove G12, the user may release rightward hook 15, permitting bar 21 to straighten in a direction opposite arrow A1, substantially back to its FIG. 2 rest condition, thereby entrapping the ski S1 in holder channel C1 substantially as in FIG. 6. In the preferred embodiment shown, the holder 10 with only one ski S1 installed may tend to maintain bar 21 slightly bent, with upper crossarm ends 53 partially straightened from their FIG. 2 rest condition.

Figure 7:
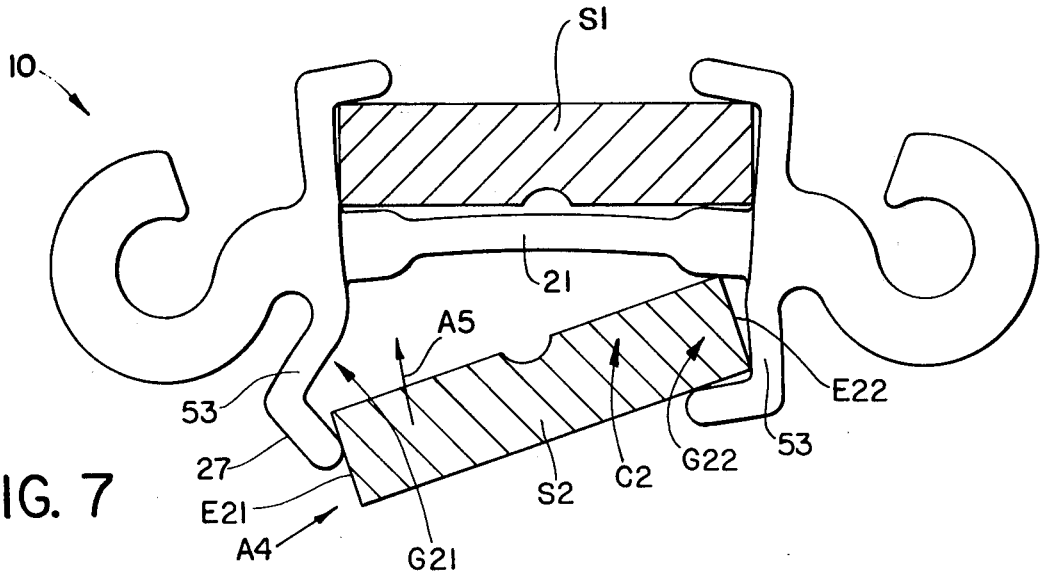

Installation of a second ski S2 (FIG. 7) in the second channel C2 of holder 10 proceeds much as above described except that the presence of ski S1 prevents significant bending of bar 21. Either edge of the ski S2 may be inserted first into channel C2, the ski edge E22 here being arbitrarily shown as being first inserted into holder groove G22, substantially in the direction of arrow A4. By bending back away from each other the crossarm ends 53, particularly the leftward crossarm end 53 and its flange 27 adjacent the trailing edge E21 of the ski S2, such edge E21 can be pivoted, substantially along the direction of arrow A5 toward bar 21 and into the holder groove G21, to its fully installed position in FIG. 8. Such installation of the second ski S2 can readily be accomplished with one hand of the operator holding the leftward flange 27 to carry out the aforementioned bending of the flange and crossarm end for entry of ski edge E21.

Figure 8:
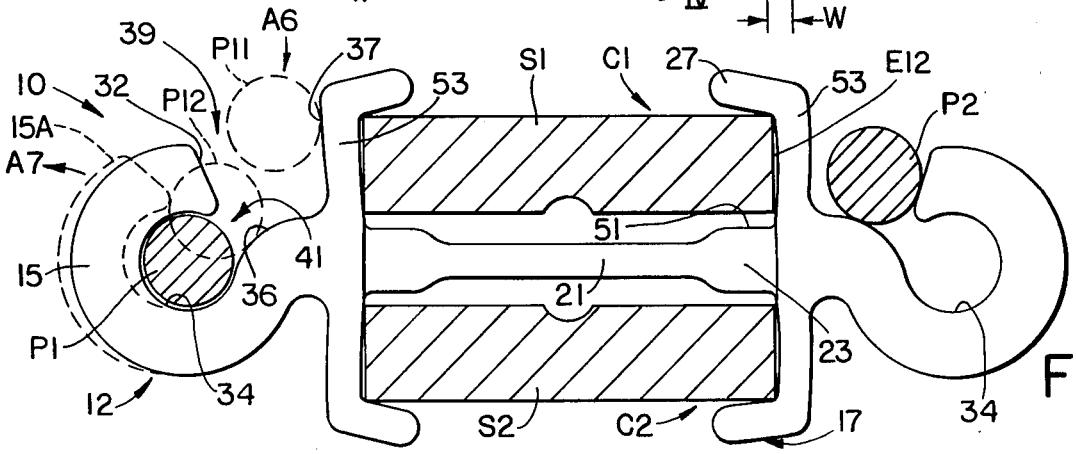
FIGS. 7 and 8 are views similar to FIG. 6 but with the second ski, respectively, being installed in and fully installed in the holder, FIG. 8 additionally showing the installation of ski poles in the holder.

With the two skis S1 and S2 fully installed in the holder 10 as seen in FIG. 8, the overlying flanges 27 block inadvertent removal of the skis from the channels C1 and C2, respectively. Moreover, the edges E of the skis are normally held snugly between the opposed crossarm ends 53, to prevent looseness of the skis within their respective channels and promote frictional securement of the holder 10 against unintended movement longitudinally of its skis. Normally, the holder is sized with respect to the skis to be carried thereby such that the semicircularly curved cross arms tend to straighten at least to an extent with the skis fully installed therein. The skis shown as models in FIG. 8 are relatively wide and can be seen to have virtually straightened the crossarms 17 promoting very snug grip by the holder. Although the bar 21 need not, and normally will not be significantly stretchable, the holder 10 permits some variations in ski width, about double the dimension W in FIG. 2, while still snugly frictionally securing the holder against longitudinal movement along the skis. By the same token, the flanges 27 will bend outwardly somewhat on the crossarm ends 53 to accommodate some variation in ski thickness, as well, relatively thick skis being shown in FIGS. 5–8 above-discussed. Depending on the thickness of the skis, additional frictional holding of the skis by the holder is accommodated by pressure on the ski edge portions between the flanges 27 and bar ends 23, particularly in the case of thicker skis.

It will be noted that the holder contacts the skis primarily on the nonrunning, or snow-engaging, surfaces thereof, notably through crossarm ends 53 at the ski edges E and through the overlying flanges 27 at the edge portions of the tops of the skis. Contact of the holder with the bottoms of the skis is minimal at most, being confined to the maximum width portions 51 of the bar ends, which contact the ski bottoms only immediately adjacent the ski edges E.

Removal of the skis from the holder 10 is accomplished essentially by reversal of the steps described above with respect to FIGS. 5–8.

Installation of the ski poles P1 and P2 is identical and for convenience is here described only with respect to pole P1. To install it, pole P1 is brought into the funnel 39 defined by hook free end 32, on the one hand, and, on the other hand, the opposed outer face 37 of crossarm 17, as shown in dotted lines at P11 in FIG. 8. Surfaces 32 and 37 lead, or funnel, the pole P11 toward the entrance 41 to pole hole 34, which faces generally inward toward the crossarm portion of the hanger-shaped portion 12. As the pole proceeds along the direction A6 it reaches the opening 41, contacting the inner portion of free end surface 32 and the opposed hump 36 as indicated at P12. At this point inward pressure on the pole, along the direction of arrow A6 causes same to bend the end of hook 15 outward, in the direction of arrow A7, and as indicated in broken lines at 15A, which widens the gap 41 sufficient to allow the pole to pop into the hole 34 and assume its fully installed position at P1. If desired, such installation may be assisted by manually engaging and bending outward, along arrow A7, the end extremity of the hook 15.

The pole P1 is securely held against inadvertent removal from hole 34 by the relatively substantial cross-sectional width of hook 15.

The second pole P2 is installed in its respective hole 34 in the same manner.

Figure 1:
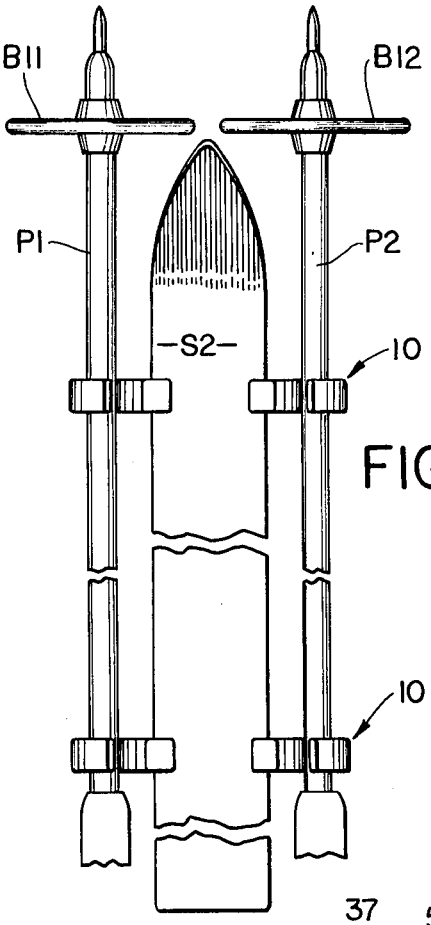
FIG. 1 is a fragmentary plan view of a pair of skis and a pair of poles secured together by a pair of holders embodying the invention.

It will be noted that with skis and poles so installed in a longitudinally spaced pair of holders 10, as seen in FIG. 1, that either of the poles, for example pole P1, can then be used as a handle to transport the skis and poles in a horizontal condition, pendent from such pole P1. The weight of the holders, the two skis and the lower pole P2 does not tend to dislodge the pole P1 from its hole 34 but rather tends merely to urge it more deeply and securely into such hole, and away from the outlet 41 of such hole. Even if substantial additional weight were added, beyond that of the skis, holders and second pole, the preformed, wide cross section hook 15 remains securely wrapped around the pole P1 with little or no deflection from its rest shape shown in FIG. 2. The hole 34 is preferably sized to tend to frictionally grip the pole to avoid unintended longitudinal sliding motion of the pole with respect to the holder.

Removal of each pole P from the opening 34 in its corresponding hook 15 is accomplished merely by pushing it out through the mouth 41 of the opening, whereby the diameter of the pole wedges open the end of the hook to its dotted line position at 15A at it proceeds in the reverse of the installation direction A6.

Because the ski poles P1 and P2 are separated substantially from each other, by a distance noticeably exceeding the width of the skis, ski poles may be aimed in the same direction (a convenience for installation and removal) without interference between the basket B of one and the pole of the other, even where relatively large diameter baskets are provided. If desired, the poles may be offset forwardly along the skis, as seen in FIG. 1, such that the baskets do not even contact the skis.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A holder for a pair of skis and a pair of ski poles comprising:

a one piece body of flexible material incorporating a pair of spaced, opposed coat hanger-shaped portions connected one to the other by an integral flexible bar;

said clothes hanger shaped portions each incorporating a crossarm extending transverse of said bar and a generally question mark shaped hook having a base integrally connected with the central portion of said crossarm and extending away from said bar, said hook further having a semicircularly curved portion integrally extending from said base and substantially enclosing a pole receiving hole, said pole receiving hole opening laterally toward the corresponding crossarm through a gap between the free end of said curved portion and the joinder of said base and curved portion.

2. The holder of claim 1, in which said crossarms of said hanger-shaped portions are semicircularly curved and oriented so their concave faces face toward each other, the end of said crossarms being bendable away from each other for receiving the width of a ski therebetween and tending to return to their concavely curved condition to grip such ski therebetween, the free extremities of said crossarm ends each carrying a flange extending transverse thereto and normally overlying said bar to assist with retention of skis between said crossarm, said crossarm ends and flanges being of continuous substantially constant cross section, said flanges being bendable in a substantially elastic manner on said crossarm ends and away from said bar to further assist in receiving the skis between said crossarms.

3. The holder of claim 2, in which the free ends of said flanges are convexly rounded to assist sliding of the edge of a ski therepast.

4. The apparatus of claim 2, in which said hook is of constant cross-sectional width throughout its base and curved portion and wherein the cross-sectional width of said hook substantially exceeds the cross-sectional width of said crossarm, said hook being sufficiently flexible in its curved portion to enable the free end of such curved portion to be moved away from the joinder of the base and curved portion for admitting or removing a ski pole with respect to the hole in said hook.

5. The holder of claim 1, in which the free end of said curved portion of said hook is spaced by less than the diameter of the pole-receiving hole from said joinder of said curved portion to said base, said free end of said hook curved portion being further spaced from the opposed outer face of one end of the corresponding crossarm, such that said free end on the one hand and said face of said crossarm and said joinder, on the other hand, form a funnel shape converging toward the opening into said pole hole, for guiding of a pole into said pole hole, and wherein the spacing of said hook free end from said opposed face of the corresponding crossarm substantially exceeds the pole hole diameter, such that the maximum dimension of said funnel shape substantially exceeds the pole diameter.

6. The holder of claim 5, in which the funnels for both hooks face transversely of the length axis of said bar and both face in the same transverse direction for convenient loading of poles.

7. The holder of claim 5, in which the free end of said hook curved portion is substantially planar and is angled sufficiently away from an intersecting radial plane of said pole hole, as to extend substantially tangential to the open side of said pole hole, so as to further assist in funneling a pole into said hole.

8. A holder for a pair of skis and a pair of ski poles consisting of a one-piece body of shape-retaining but bendable synthetic resin material, said one piece body incorporating:

a pair of spaced, opposed and mirror imaged coat hanger shaped portions of uniform thickness connected by an integral bar of lesser, but uniform, thickness;

said clothes hanger-shaped portions each incorporting a curved crossarm with the curvature oriented so that said crossarms face concavely toward each other, the ends of said bar entering the middle of said crossarm concavity, said clothes hanger shaped portions further including integral flanges on the ends of said concavely opposed crossarms;

said clothes hanger-shaped portions each further including a substantially question mark shaped hook having a base integral with the central portion of the corresponding crossarm and a semicircular curved portion extending from said base away from said bar and curving around to terminate in a free end facing toward and remotely spaced from one end of said crossarm, the joinder of the base and curved portions of the hook being close spaced from and facing convexly toward said free end, the hook being of greater cross sectional area than the corresponding crossarm;

the curved portion of said hook being flexible to open the space between its free end and said joinder for admittance of a ski pole laterally therebetween into the circular hole enclosed by the semicircular portion of the hook for releasable retaining of said ski pole therein, the ends of each said crossarm and the flanges on the said ends both being flexible to permit the opposed crossarm ends to bend away from each other and also to permit said flanges to bend away from said bar for insertion of a ski in the space bounded by said bar and the opposed halves of each crossarm, the crossarm ends being of greater flexibility than the curved portions of said hooks.

* * * * *